US005833167A

United States Patent [19]

Thuer et al.

[11] Patent Number: 5,833,167

[45] Date of Patent: Nov. 10, 1998

[54] TRANSPORT SYSTEM FOR CONVEYING A REEL OF PAPER TO A REEL CHANGER

[75] Inventors: Walter Thuer, Friedberg; Xaver Schorer, Dinkelscherben, both of Germany

[73] Assignee: Man Roland Druckmaschinen AG, Offenbach am Main, Germany

[21] Appl. No.: 865,927

[22] Filed: May 30, 1997

[30] Foreign Application Priority Data

May 30, 1996 [DE] Germany ..... 296 29 589.3

[51] Int. Cl.[6] ..... B65H 19/12

[52] U.S. Cl. ..... 242/559; 414/750; 414/911

[58] Field of Search ..... 242/559, 559.1, 242/559.2, 559.3, 559.4; 414/749, 750, 911

[56] References Cited

U.S. PATENT DOCUMENTS

| | | | |
|---|---|---|---|
| 3,462,094 | 8/1969 | Shumaker | 242/559 |
| 3,567,151 | 3/1971 | Mellen | 242/559 |
| 4,131,206 | 12/1978 | Kawada et al. | 242/559.4 |
| 4,749,079 | 6/1988 | Minto | 414/750 |
| 4,948,060 | 8/1990 | Kurz et al. | 242/559.2 |
| 5,044,862 | 9/1991 | Herigstad et al. | 242/559 |

FOREIGN PATENT DOCUMENTS

| | | | |
|---|---|---|---|
| 39 10 444 | 10/1990 | Germany . | |
| 403099721 | 4/1991 | Japan | 242/559.4 |
| 405084516 | 4/1993 | Japan | 242/559.4 |
| WO89 08 598 | 9/1989 | WIPO . | |

*Primary Examiner*—John M. Jillions

*Attorney, Agent, or Firm*—Cohen, Pontani, Lieberman & Pavane

[57] ABSTRACT

An adaptable carriage arranged in a transfer table located in front of the reel changer of a reel-fed rotary printing machine, the adaptable carriage accommodating a transport means such as, for example, a transport car or a transport cradle, on which the paper reel is loaded. The adaptable carriage, together with the paper reel, is brought into the loading position for the reel changer. Thereafter, the transfer table, together with the transport means, is moved in the direction of the carrying arms of the reel changer, so that the clamping pins of the reel changer can engage into the core of the paper reel. The adaptable carriage of the present invention is used in cases when the transport means is moved on the transfer table automatically. However, according to the present invention, it is also possible to easily remove the adaptable carriage, so that the transport means can be moved manually.

13 Claims, 7 Drawing Sheets

TRANSPORT SYSTEM FOR CONVEYING A REEL OF PAPER TO A REEL CHANGER

BACKGROUND OF THE INVENTION

1. Field of the Invention

The present innovation relates to a transport system and more particularly, to a transport system having a transport means for conveying a reel of paper to a reel changer of a reel-fed rotary printing machine.

2. Description of the Related Art

German Patent No. DE 3910444 A1 discloses a process and apparatus for conveying a reel of paper to a reel-fed rotary printing machine. Using a means of transport such as, for example, a carriage that runs on rails, reels of paper are brought from an intermediate reel store to reel changers, where they are unpacked and prepared for automatic adhesion. The reel of paper is placed into the carrying arm of the reel changer with the help of a lifting device.

SUMMARY OF THE INVENTION

It is accordingly an object of the present invention to provide, in a paper reel transport system, a simple device for conveying a reel of paper, i.e. a paper reel, to the carrying arm of the reel changer for use on a reel-fed rotary printing machine.

According to the present invention, an adaptable carriage is arranged on a transfer table located in front of the reel changer of a reel-fed rotary printing machine. The adaptable carriage accommodates a transport means such as, for example, a transport car or a transport cradle, on which the paper reel is loaded. The transport means, together with the paper reel, is brought into a loading position on the transfer table. Thereafter, the transfer table, together with the transport means, is moved in the direction of the reel changer, so that the clamping pins located at the ends of the carrying arms of the reel changer can align with and engage the core of the paper reel. The adaptable carriage of the present invention is used in cases when the transport means is moved on the transfer table automatically. However, according to the present invention, it is also possible to easily remove the adaptable carriage, so that the transport means can be moved manually.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

The present invention provides a novel and unique apparatus for loading a paper reel onto a reel-fed rotary printing machine. Using a movable transfer table having a slidable carriage and a slidable catch device mounted thereon, a reel of paper can be easily and reliably moved into position for manual or automatic placement on the printing machine. A transport cradle or transport car for carrying the reel of paper is removably placed on the carriage and held thereon by a catch device. The transfer table is then moved to a position near the reel changer of a rotary printing machine in preparation for replacement of a spent reel of paper on the reel changer. The apparatus of the present invention advantageously includes selectively detachable alignment or guidance rails to secure the carriage and reel of paper during transport. The rails may be detached, i.e. their engagement with the carriage released, to compensate for slight lateral offset between the reel of paper carried by the transfer table and the pins of the carrying arms of the reel changer that engage a center core of the reel of paper to manipulate the reel from the transfer table to the printing machine.

Figure 1:
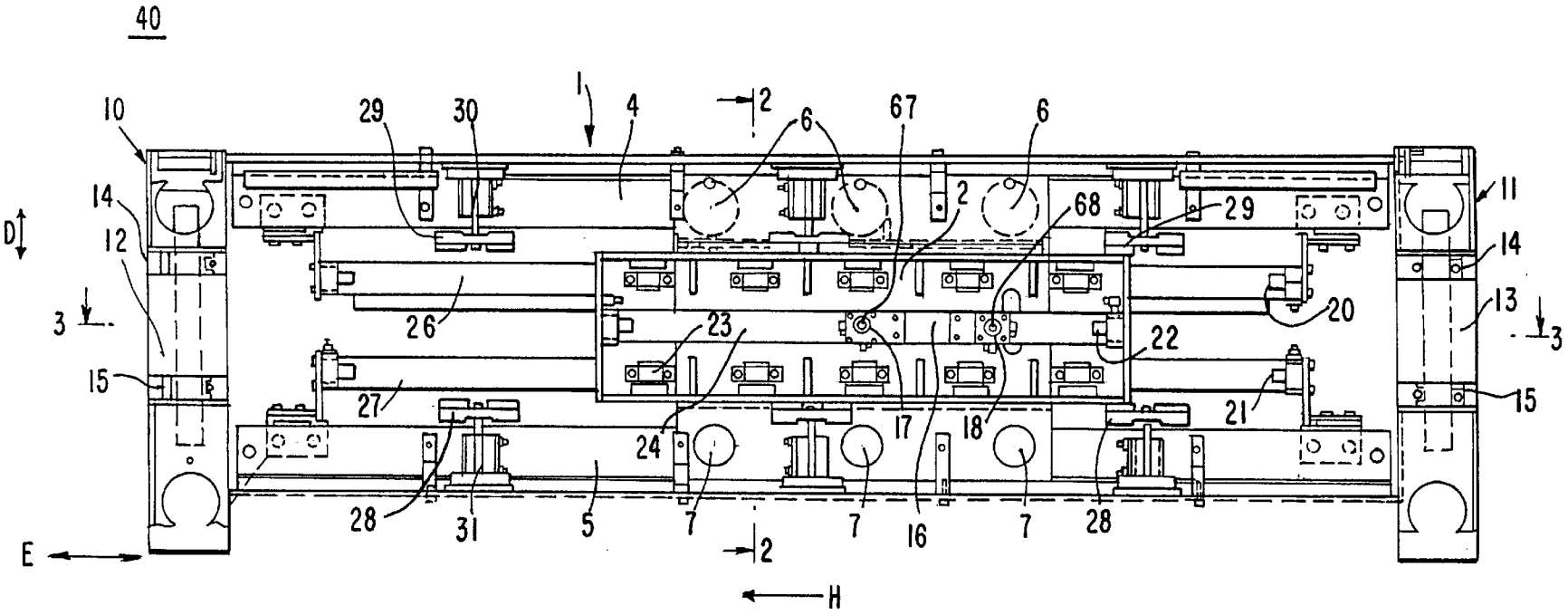
FIG. 1 is a top view of a first embodiment of a transfer table configured according to the present invention.
Figure 2:
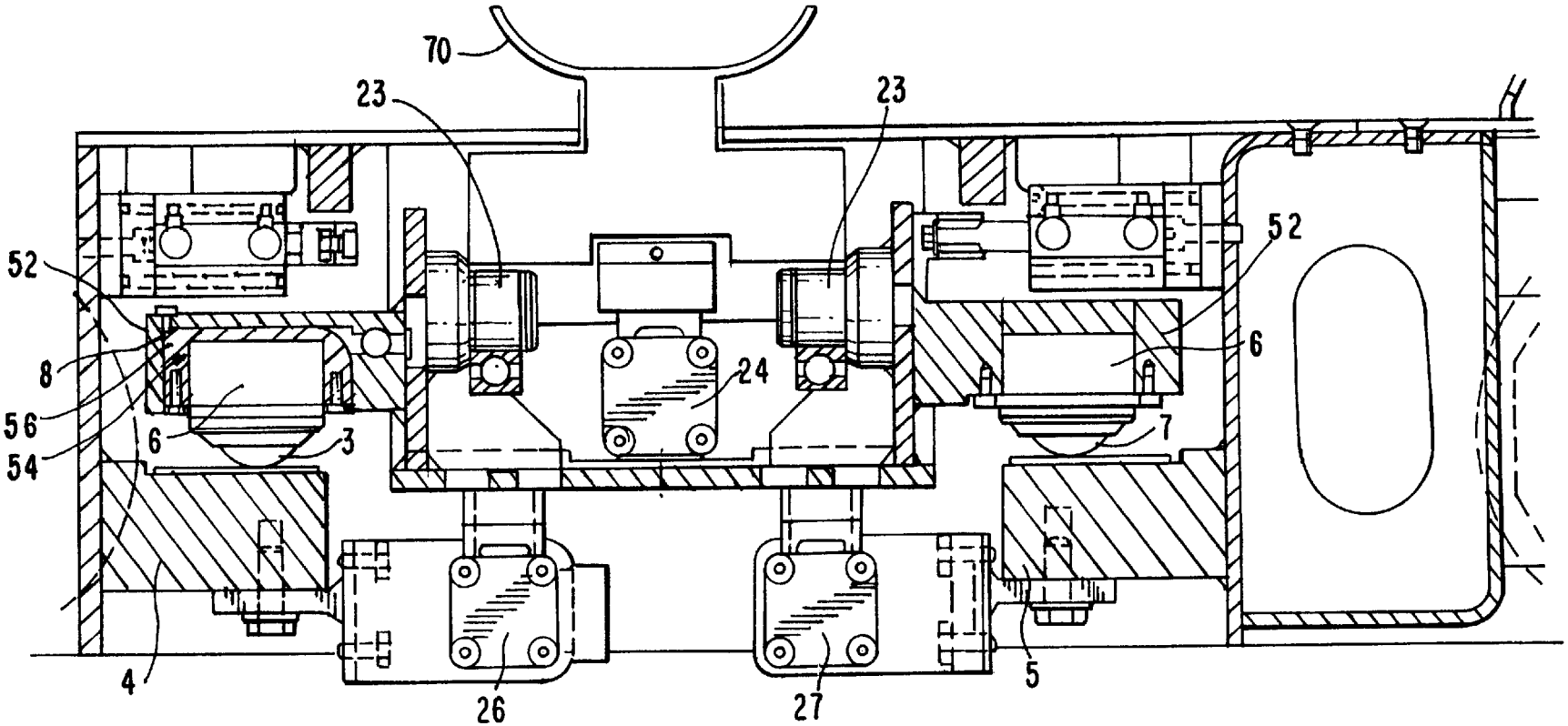
FIG. 2 is an enlarged cross-sectional view of the transfer table taken along line 2—2 of FIG. 1.
Figure 3:
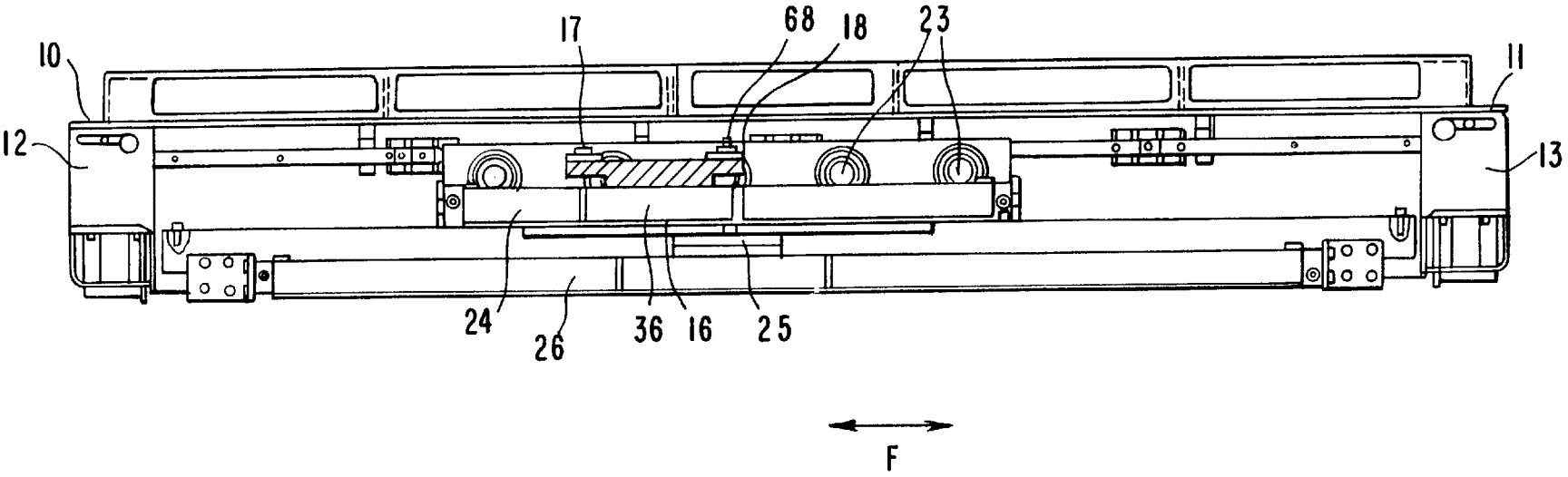
FIG. 3 is a longitudinal cross-sectional view of the transfer table taken along line 3—3 of FIG. 1.

Referring now to the drawings in detail, FIGS. 1, 2 and 3 depict a first embodiment of the present invention. FIG. 1 is a top view of a transport system 40 configured according to the present invention. The transport system 40 includes a transfer table 1 that is movable toward or away from a reel changer 60 of a reel-fed rotary printing machine 50, as indicated by double-arrow D of FIGS. 1 and 7. The paper 72 carried on a paper reel 66 travels off the reel in a running direction substantially aimed into the printing machine 50 (see FIG. 7). The transfer table 1 is also movable in a direction that is substantially perpendicular to the running direction of the paper and with respect to the reel changer 60, as indicated by double-arrow E of FIG. 1. The transfer table 1 includes an adaptable carriage 2 that is mounted on ball rollers 3, 7—the rollers 3, 7 being rollable along laterally disposed rails 4, 5 provided on the transfer table 1 thereby permitting movement of the carriage 2 longitudinally along the transfer table 1, i.e. in the direction of double-arrow E of FIG. 1. A cylinder mounting member 52 is provided on the adaptable carriage 2 that extends substantially horizontally outward on opposite sides thereof. The mounting members 52 are substantially parallel to the rails 4, 5. A plurality of cavities 56 are defined in a bottom surface of the mounting member 52, each cavity 56 being configured for housing a cylinder 6—each cylinder having a ball roller 3, 7 fixedly mounted therein. The cylinders 6 are sized such that a void remains within the cavity between the cylinder 6 and the interior peripheral wall of the cavity 56 when the cylinder 6 is located in the cavity 56. A liquid 8 is disposed within the cavity 56 and fills the void so as to absorbingly surround each cylinder 6—at least insofar as the top and mantle surfaces of the cylinder 6 are concerned. The liquid 8 and cylinder 6 are secured in the cavity 56 by a rubber ring or seal 9. In a preferred embodiment, a manometer 54 or other suitable pressure measurement or detection device is located in the cavity 56 to determine the weight borne by the transfer table 1 as a paper reel 66 is carried or rests thereupon or, alternatively, to determine if the weight of the paper reel 66 carried by the table 1 exceeds a predetermined maximum load for the transfer table 1 and its 20 associated components.

The transfer table 1 includes end walls 10, 11 located at its longitudinal ends and having respective openings 12, 13 defined therein. The openings 12, 13 are sized and shaped to permit ingress to and egress from the transport table 1 by a transport means such as, for example a transport cradle 70 or transport car 80 (see e.g. FIGS. 2 and 5). The terms transport cradle and transport car are used interchangeably throughout this application, it being understood that these terms represent similar functional elements of various embodiments of the present invention. A light emitting device 14 is used together with a light detecting device 15 to create a light curtain, screen or barrier across each opening 12, 13 in the respective end wall 10, 11 of the transport table 1. Employing suitable known signal processing means in conjunction with the light emitting and detecting devices 14, 15, it is possible, according to the present invention, to automatically detect when an object such as, for example, a transport cradle 70, passes through either opening 12, 13. It is further possible to control various other elements of the inventive transport system 40 from the automatic detection of a violation of the light barrier, as described in more detail below.

A catch device 16 is provided on the adaptable carriage 2 that includes two pneumatic cylinders 17, 18 having respective deployable pistons 67, 68. When a transport cradle 70 breaks or passes through the light curtain across opening 13, i.e. when the cradle 70 is moving from right to left in FIG. 1, for example, the piston 67 of cylinder 17 is activated and caused to extend substantially upward to serve as a stop that arrests the forward movement, i.e. movement to the left in FIG. 1, of the transport cradle 70. Once the transport cradle 70 contacts the upwardly extended piston 67 of cylinder 17, piston 68 of cylinder 18 is caused to be deployed generally upwardly. The transport cradle 70 includes a detent means (not shown), preferably a bore, defined in a surface that rests confrontingly opposite pistons 67 and 68. The detent means is sized and configured so that deployed piston 68 is positively engaged therein. The position of the transport cradle 70 is thereby secured on the adaptable carriage 2 by pistons 67 and 68.

Alternatively, if the transport cradle 70 breaks the light curtain across opening 12, i.e. if the cradle 70 is moving from left to right in FIG. 1, the piston 68 of cylinder 18 is first activated and caused to extend substantially upward, thereby arresting the forward movement of the cradle 70. The operation of piston 67, in response, is identical to the foregoing operational description of piston 68.

Two stops 20, 21 are provided on each longitudinal end of the transfer table 1 near the openings 12, 13 to define and limit the maximum longitudinal movement of the adaptable carriage 2 along the transfer table 1. Two stops 22 are also provided on the longitudinal ends of the adaptable carriage 2 to define and limit the maximum longitudinal movement of the catch device 16 along the carriage 2. In a preferred embodiment, the carriage 2 rests against the stops 20, 21 at one end of the transfer table 1, i.e. at the end near end wall 11, and the catch device 16 rests against stop 22 at the same end of the transfer table 1 when a transport cradle 70 is moved onto the transfer table 1. Movement of the catch device 16 and carriage 2 to the aforementioned rest positions is initiated by an interruption of the light curtain 20 at opening 13.

The adaptable carriage 2 further comprises a plurality of stationary rollers 23 that permit the transport cradle 70 to rollingly move longitudinally along the carriage 2 after the cradle 70 is secured in place by pistons 67 and 68—even while the carriage 2 remains stationary. From its initial position (for accepting a transport cradle 70) against stop 22, the catch device 16 may be caused to move away therefrom after a transport cradle 70 has been removably affixed thereto, i.e. by pistons 67 and 68. Preferably, the catch device 16 is caused to move, carrying the transport cradle 70, in the direction of arrow H (FIG. 1) until the cradle 70 is located approximately in the longitudinal center of the adaptable carriage 2. To further facilitate the movement of the cradle 70 along the carriage 2 while the carriage 2 is at rest, a portion of the catch device 16 is substantially cylindrical, preferably embodied as a piston 36, and disposed within a hollow rail or tube 24—the hollow rail 24 extending longitudinally along the bottom of the carriage 2 and the piston 36 being configured for substantially linear movement therein. As shown more clearly in FIG. 3 and as indicated by double-arrow F, the piston 36 is movable along a substantially linear path that is limited to a distance shorter than the length of the adaptable carriage 2. Movement of the piston 36, and subsequently of the catch device 16, is preferably facilitated by pressurized air injected into the hollow rail 24, although other means of moving the piston 36 within the rail 24 are contemplated by the present invention, e.g. hydraulic or electric means. In addition, although the preferred cross-sectional shape of the hollow rail 24 and piston 36 is circular, other cross-sectional shapes will provide the same functionality provided, of course, that the hollow rail 24 and piston 36 have the same cross-sectional shape.

After the catch device 16 has been moved to the center of the carriage 2, as described hereinabove, the carriage 2 may be caused to move likewise, i.e. toward the longitudinal center of the transfer table 1. Two pistons 25 are attached to a lower side of the adaptable carriage 2 and are movably disposed within two hollow rails or tubes 26, 27 that are located near and laterally about opening 12—the rails 26, 27 extending substantially parallel to each other longitudinally along the transfer table 1 and terminating near and about opening 13. The pistons 25 and hollow rails 26, 27 facilitate the longitudinal movement of the carriage 2 along the transfer table 1. Pressurized air is preferably used to move the pistons 25 within the hollow rails 26, 27, although other means of moving the piston 25 within the rails 26 and 27 may provide the same desirable results, e.g. hydraulic or electric means. In addition, although the preferred cross-sectional shape of the hollow rails 26, 27 and piston 25 is circular, other cross-sectional shapes will provide the same functionality provided, of course, that the hollow rails 26, 27 and piston 25 have the same cross-sectional shape.

Lateral movement of the adaptable carriage 2 is limited by guidance rails 28, 29 that are located opposite each other on the sides of the transfer table 1 near each opening 12, 13and near the longitudinal center of the transfer table 1. The rails 28, 29 are selectively movable so as to frictionally encounter opposite sides of the carriage 2 thereby providing lateral stabilization while a transport cradle 70 and paper reel 66 are being placed on the transfer table 1 and while the table 1 is being moved. The guidance rails 28, 29 are selectively positionable generally toward and away from each other by pneumatic cylinders 30, 31 attached thereto using, for example, pressurized air. It is thereby possible, according to the present invention, to accommodate and secure a variety of different width carriages 2 due to the selectable and variable width control and stabilization provided by the combination pneumatic cylinders 30, 31 and guidance rails 28, 29.

Figure 7:
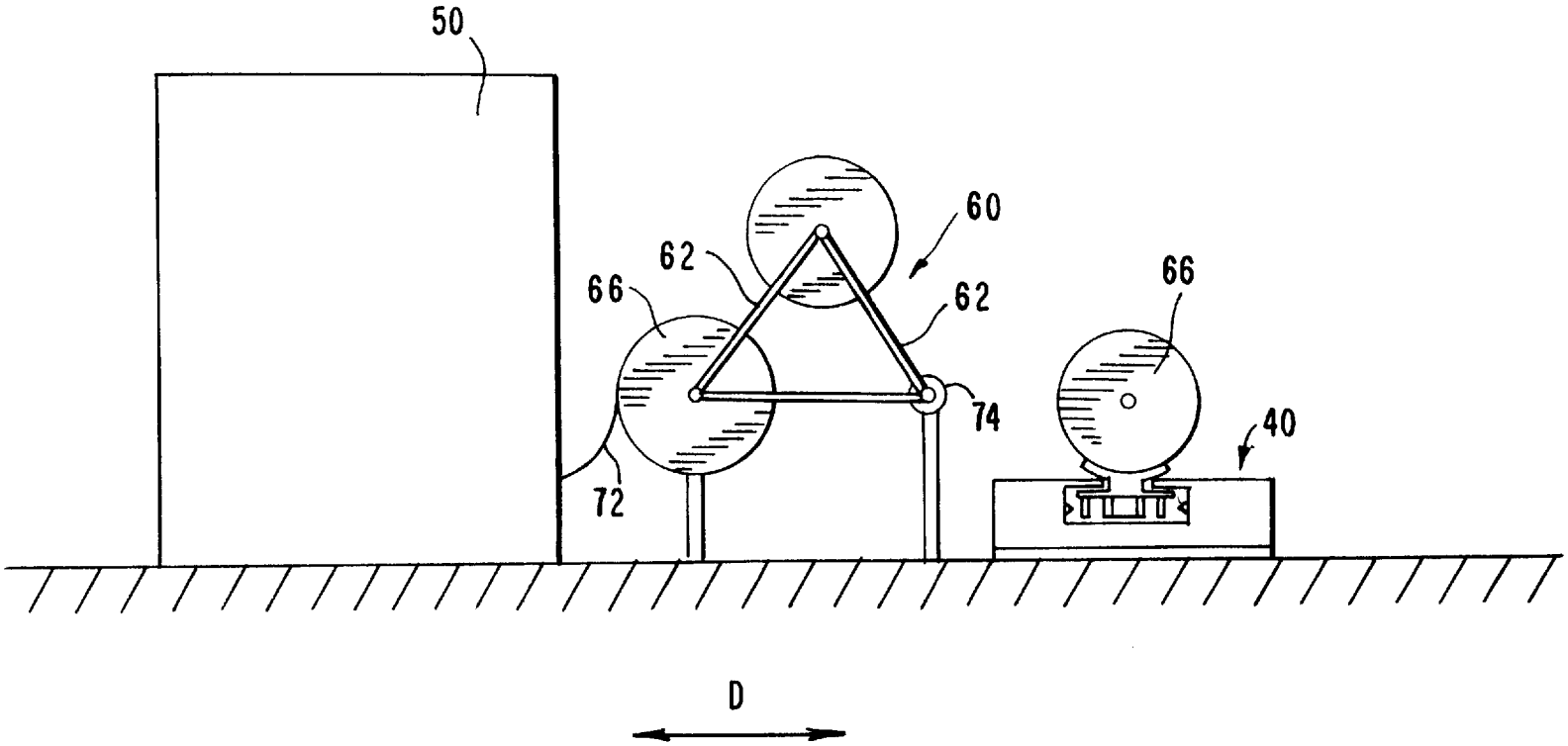
FIG. 7 is a schematic side view of a rotary printing machine, a reel changer, and a transfer table according to the present invention.

After the adaptable carriage 2 has been positioned approximately at the longitudinal center of the transfer table 1, the transfer table 1 is moved by an external device (not shown) in the direction of the reel changer 60, i.e. in the direction of double-arrow D in FIGS. 1 and 7. To compensate for a possible misalignment between the pins (not shown) of the carrying arms 62 of the reel changer 60 and of the carrier sleeve (not shown) of the paper reel 66, the guidance rails 28, 29 are detached, i.e. moved away from the sides of the adaptable carriage 2, thereby permitting limited lateral movement of the carriage 2 and paper reel 66. The combination of the guidance rails 28, 29 and ball rollers 3, 7 facilitate such limited lateral movement of the carriage 2 within the transfer table 1.

Figure 4:
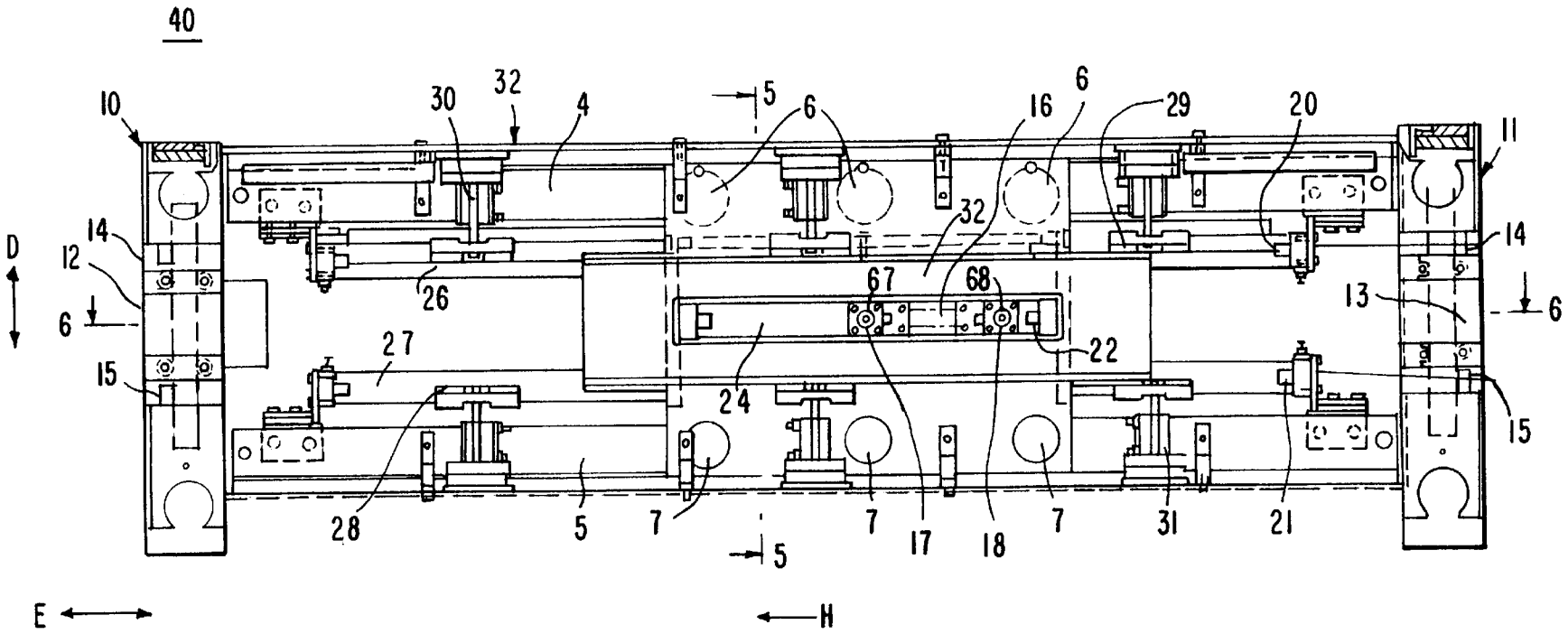
FIG. 4 is a top view of a second embodiment of the transfer table configured according to the present invention.
Figure 5:
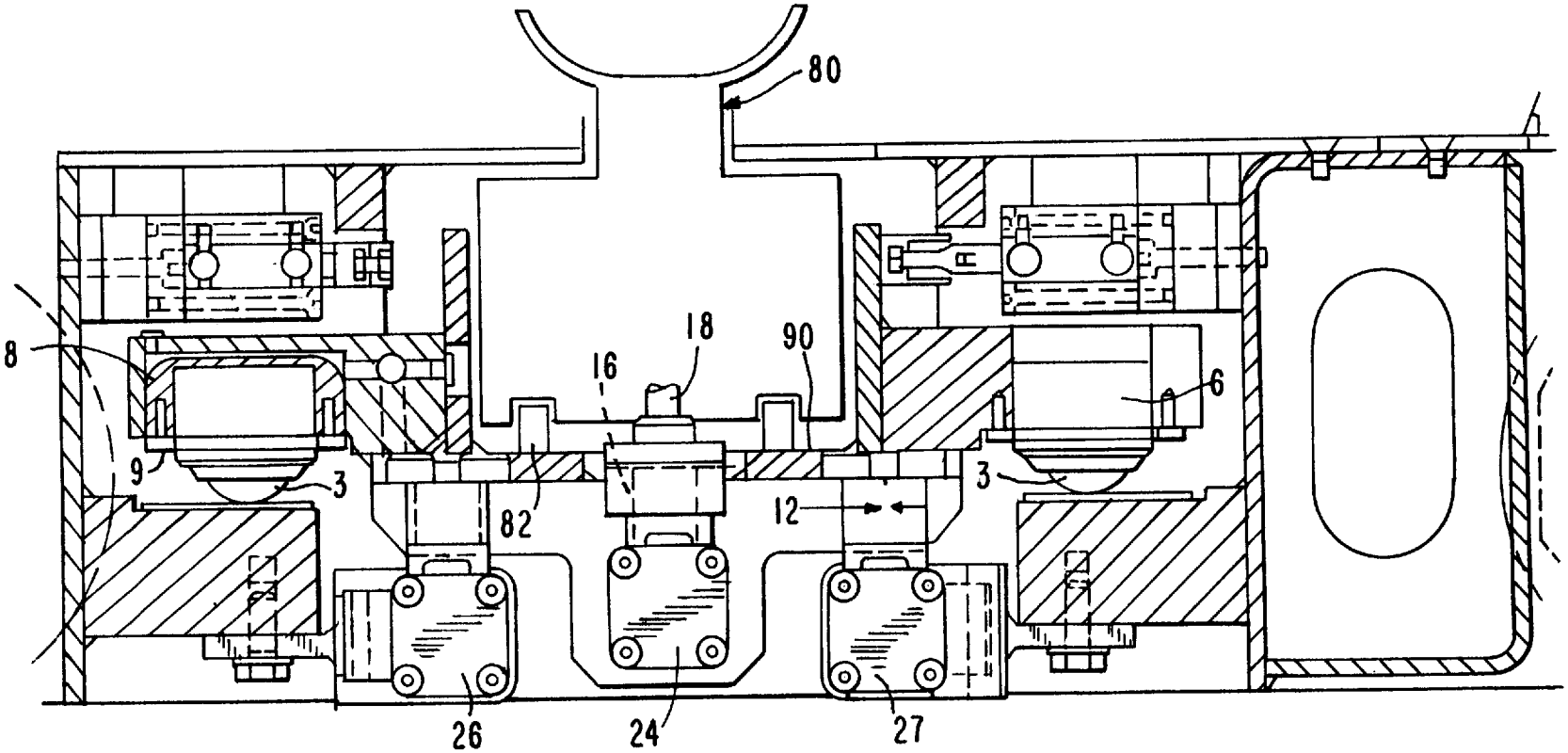
FIG. 5 is an enlarged cross-sectional view of the transfer table taken along line 5—5 of FIG. 4.
Figure 6:
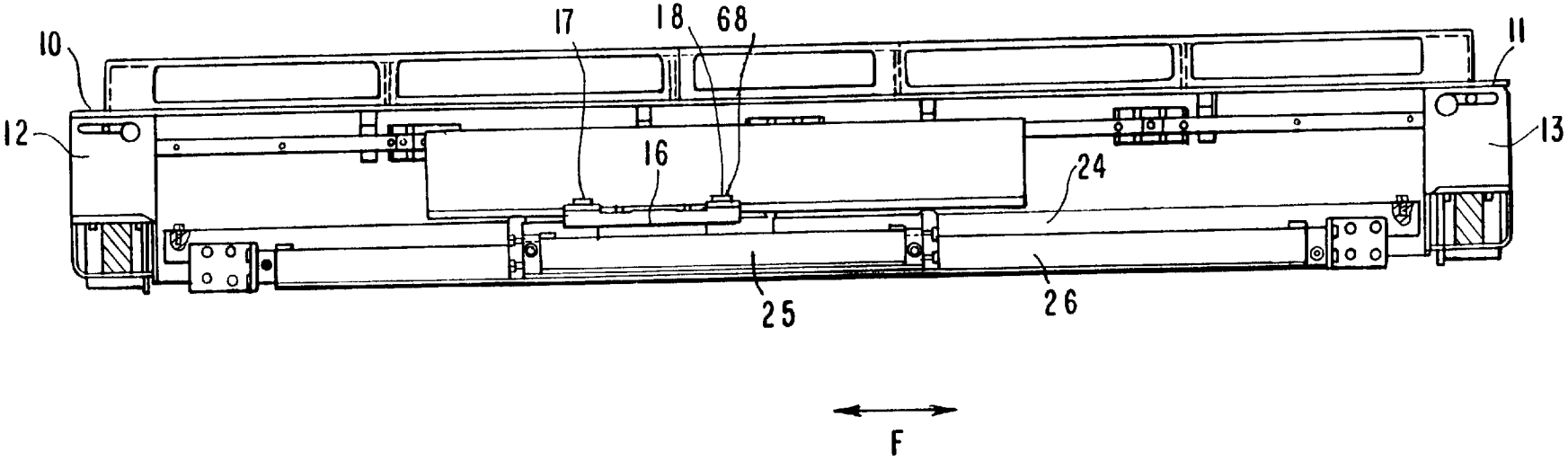
FIG. 6 is a longitudinal cross-sectional view of the transfer table taken along line 6—6 of FIG. 4.

Referring next to FIGS. 4–6, an alternative embodiment of the present invention is shown and will now be described in greater detail. The transport cradle 70 has been replaced with a transport car 80 mounted to an adaptable carriage 32. As shown more clearly in FIG. 5, the transport car 80 includes a plurality of wheels 82 that rollingly travel along a substantially horizontal surface 90 of the adaptable carriage 32. In contrast to the embodiment disclosed and described hereinabove, the adaptable carriage 32 of the embodiment of FIGS. 4–6 is not equipped with rollers 23, although the wheels 82 provide similar functionality as the rollers 23, i.e. the wheels 82 permit the transport car 80 to rollingly move across a stationary carriage 32, and the operation of the embodiment of FIGS. 4–6 in other regards does not differ substantially from the above described and disclosed embodiment of FIGS. 1–3. Accordingly, the transport car 80 is selectively movable independent of the adaptable carriage 32 by means of the catch device 16 and wheels 82. As described hereinabove for the transport cradle 70, the transport car 80 will similarly removably attach to the catch device 16 when the latter is initially positioned against stop 22—the carriage 32 being positioned against stops 20 and 21 at the same time—in response to an article (e.g. a transport car 80) passing through the light barrier present across opening 13. Thereafter, the catch device 16 and attached transport car 80 are caused to move to the approximate longitudinal center of the carriage 32, followed by similar movement of the adaptable carriage 32 along the transfer table 1.

Although the various deployable elements of the present invention, e.g. pneumatic cylinder 17, 18 and pistons 27, 28, pneumatic cylinder 30, 31 and guidance rail 28, 29, were disclosed as being pneumatically operable, they may alternatively be hydraulically or electrically operable without deviating from the present invention.

A computer or other suitable control system may be employed to coordinate the deployment of the various selectively positionable elements, e.g. catch device 16, adaptable carriage 2, guidance rail 28, 29, pneumatic cylinder 17, 18, etc.

In a further alternate embodiment, the adaptable carriage 2, 32 may be removed from the transfer table 1 to facilitate manual operation of the inventive apparatus.

In operation, the present invention provides an apparatus uniquely configured and especially suited for automatically or manually replacing an empty paper reel 74 from the reel changer 60 of a roll-fed rotary printing machine 50. When a paper reel on a reel changer 60 is depleted, the inventive apparatus facilitates its automatic or manual replacement—the following operational description being directed to the automatic operation of the present invention, and particularly for movement of a transport cradle 70 from right to left (as in FIG. 1), it being understood that such description applies equally to the manual operation and to movement of a cradle 70 (or transport car 80) from left to right. A new reel 66, carried on a transport cradle 70 is moved so that the transport cradle 70 passes through opening 13 thereby breaking the light curtain created thereacross by the light emitting and detecting devices 14, 15. Consequently, the adaptable carriage 2 and catch device 16 are caused to move longitudinally along the transfer table until they come to rest against stops 20, 21 and 22, respectively, located near encroached opening 13. The carriage 2 and catch device 16 are caused to move, respectively, by pistons 25 and 36 located within respective hollow rails 26, 27 and 24.

Both pistons 67 and 68, included in respective pneumatic cylinders 17 and 18, are initially in a retracted or non-deployed state, i.e. are located within the cylinders 17, 18. Once the transport cradle 70 passes through the opening 13, piston 67 is caused to extend in a substantially vertical or upward direction to a length and extent sufficient to stop the longitudinal movement of the transport cradle 70 along the transfer table 1. The cradle 70 will ultimately contact extended piston 67, causing piston 68 to deploy in a substantially vertical direction, into a detent or hole defined in the bottom side of the cradle 70 thereby securing the cradle 70 to the carriage 2. Guidance rails 28, 29, driven respectively by pneumatic cylinders 31 and 30, frictionally confront opposite side walls of the transport cradle 70 to stabilize the cradle 70 and paper reel 66 mounted thereon.

Longitudinal movement of the cradle 70 and paper reel 66 along the transfer table 1 is now possible under the control and direction of the catch device 16 and adaptable carriage 2. The piston 36 is first caused to move within hollow rail 24, thereby moving the attached catch device 16, until the catch device 16 is located approximately at the longitudinal center of the adaptable carriage 2. A plurality of stationary rollers 23 are provided on the adaptable carriage 2 upon which the paper reel 66 moves as the cradle 70 is longitudinally centered. It is now possible and desirable to longitudinally center the adaptable carriage 2 on the transfer table 1 using pistons 25 disposed within hollow rails 26 and 27. Thereafter, the transfer table 1, now carrying a full paper reel 66, can be moved into position for placement of the reel on to the reel changer 60.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. It is the intention, therefore, to be limited only as indicated by the scope of the claims appended hereto.

What is claimed is:

1. An apparatus for conveying a paper reel to a reel changer of a reel-fed rotary printing machine, the reel changer being located near the printing machine and carrying at least one paper reel, the paper running from the reel to the printing machine in a running direction, said apparatus comprising:

a transfer table located adjacent the reel changer and being selectively movable in a first direction that is substantially the same as the running direction of the paper;

a transport means for carrying a paper reel; and an adaptable carriage mounted on said transfer table for selective movement in a second direction that is substantially perpendicular to the running direction of the paper, said transport means being removably mounted on said carriage for selective movement over said carriage in said second direction.

2. The apparatus of claim 1, further comprising:

two rails disposed on opposite sides of and extending longitudinally along said transfer table; and a plurality of ball rollers mounted on said adaptable carriage and disposed in contactingly rolling relation with said rails, said ball rollers enabling selective movement of said adaptable carriage on said rails.

3. The apparatus of claim 2, further comprising:

a mounting member extending outwardly from the side of said adaptable carriage in a substantially horizontal direction, said mounting member having a plurality of cavities defined therein;

a plurality of cylinders for holding each one of said ball rollers, each one of said cylinders being disposed in one of said cavities so as to define a void between said cylinder and an interior peripheral wall of said cavity, said void being filled with a liquid that surroundingly envelops said cylinder; and a pressure sensing means disposed within said cavity for sensing the pressure exerted on said ball rollers via said adaptable carriage.

4. The apparatus of claim 1, further comprising a catch device mounted on said adaptable carriage, said transport means being movable in said second direction during removable mounting of said transport means to said adaptable carriage, said catch device being configured to arrest said mounting movement of said transport means on said adaptable carriage.

5. The apparatus of claim 4, wherein said catch device further comprises a lower part configured as a piston, said adaptable carriage further comprising a hollow rail extending longitudinally therealong, said piston being disposed within said hollow rail for substantially linear and longitudinal movement therein.

6. The apparatus of claim 5, wherein said piston is moved pneumatically within said hollow rail.

7. The apparatus of claim 1, further comprising a rail connected to and extending longitudinally along said transfer table, said adaptable carriage further comprising a piston connected to a bottom of said adaptable carriage, said piston being sized and shaped for substantially linear and longitudinal movement along said rail.

8. The apparatus of claim 7, wherein said piston is moved pneumatically along said rail.

9. The apparatus of claim 1, further comprising:

a plurality of guidance rails disposed laterally about and longitudinally along said transfer table and being selectively movable between a first position in which said rails substantially prevent lateral movement of said adaptable carriage and a second position in which said rails substantially permit lateral movement of said adaptable carriage; and a cylinder connected to each of said guidance rails for selectively moving each of said rails between said first and said second positions.

10. The apparatus of claim 1, wherein said adaptable carriage further comprises a plurality of stationary rollers affixed thereto, said rollers facilitating movement of said transport means in said second direction over said adaptable carriage.

11. The apparatus of claim 4, further comprising:

means for generating a light barrier, said means being located at opposite longitudinal ends of said transfer table; and means for detecting when an object passes through said light barrier;

said catch device being caused to move in said second direction when said detecting means detects that an object has passed through said light barrier.

12. The apparatus of claim 5, wherein said piston is moved within said hollow rail by a positioning means selected from a group consisting of a hydraulic means and an electric means.

13. The apparatus of claim 7, wherein said piston is moved along said rail by a positioning means selected from a group consisting of a hydraulic means and an electric means.

* * * * *